US005603680A

United States Patent [19]

Larsen

[11] Patent Number: 5,603,680

[45] Date of Patent: Feb. 18, 1997

[54] LOCKING COLLAR FOR A BARBELL OR DUMBBELL

[76] Inventor: Laird L. Larsen, 3826 N. Kenneth Ave., Chicago, Ill. 60641

[21] Appl. No.: 313,422

[22] Filed: Sep. 27, 1994

[51] Int. Cl.[6] ..... A63B 21/075

[52] U.S. Cl. ..... 482/107; 24/523

[58] Field of Search ..... 482/106–108; 403/322, 325; 24/522–524

[56] References Cited

U.S. PATENT DOCUMENTS

| | | | |
|---|---|---|---|
| 2,207,892 | 7/1940 | Mullaney | 24/523 X |
| 3,336,642 | 8/1967 | Armacost | 24/524 X |
| 4,707,891 | 11/1987 | Chidester | 24/523 X |
| 5,295,934 | 3/1994 | Collins et al. | 482/107 |

*Primary Examiner*—Lynne A. Reichard
*Assistant Examiner*—John Mulcahy
*Attorney, Agent, or Firm*—Brinks Hofer Gilson & Lione

[57] ABSTRACT

A collar to secure weights on a barbell or dumbbell. Two springs are biased against a pad support on one end and against the partially closed top surfaces of cylindrical tubular casings on the other end. The radially extending legs of a grip bar connect to the pad support through the cylindrical tubular casings, allowing the pad support to raise off the barbell. A grip pad made of compressible material is disposed on the surface of the pad support and grippingly engages the barbell when the springs are fully extended, thereby securing the weights on the barbell. The collar has a substantially cylindrical housing where one end of the cylindrical housing has a greater diameter than the other end, forming a flange to secure the weights on the bar. The end of the cylindrical housing forming a flange has a fluted contact base made of a compressible material to prevent slippage between the contact base and a contiguous weight.

2 Claims, 2 Drawing Sheets

50
38
39
40
44
51
42
45
68
64
56
58
54
62
60
70
72
74
76
52
54
78
66

LOCKING COLLAR FOR A BARBELL OR DUMBBELL

BACKGROUND OF THE INVENTION

The present invention relates generally to a locking collar, and more particularly, to collars used to hold weights on the ends of barbells or dumbbells.

There are various types of barbell or dumbbell collars (hereinafter referred to collectively as "barbells") available to weight lifters. Collars are necessary because barbells used in weight lifting usually come with weights of varying sizes that must be secured on the ends of the barbell. The weights can be utilized in various combinations on the barbell, allowing the user to select a desired total weight. Typically, the weights are disk-shaped with holes in their centers so that the weights can be fitted onto the ends of the barbell. The weights are secured on the ends of the barbell between dual stops which sometime take the form of a fixed inner collar and an outer collar. Although both collars may be adjustable as to their position on the barbell, for purposes of simplicity the following discussion will refer to the outer collar as removable and the inner collar as fixed. While the majority of inner collars on the market are now fixed stops, it will be recognized that the present invention may also be used as the inner collar.

Obviously, it is desirable for the collar to secure the weights effectively so that weights cannot fall off the end of the barbell and cause injury to a weight lifter or a bystander. It is particularly hazardous for a weight to become dislodged during lifting because the barbell becomes imbalanced and often uncontrollable.

Safety can also be a problem when weights are added or removed from a barbell because at that time the barbell will be imbalanced if the weights are not removed from each side of the barbell simultaneously. Most prior art collars are placed on the barbell by sliding them on and off the end of the barbell, in the same manner that weights slide on and off the ends of the barbell. Thus, most collars currently on the market must be removed from the barbell to effect a weight change. When, as is often the case, central portions of the barbell are supported on a rack while weights are added or removed from the ends of the barbell, the barbell can become sufficiently imbalanced to topple the rack or tilt the barbell. In these situations, the weights will often spill off the end of the barbell in the absence of a collar on the barbell to hold the weights thereon. When this is the case, a properly secured collar may limit or prevent injuries or property damage.

The correlation between safety and convenience in prior art collars may explain why some prior art collars are predisposed to create the very problems that they are designed to avoid. Since some prior art collars are not easily removed from or placed onto a barbell, many weight lifters ultimately choose not to use them. An example of one such collar is the conventional set screw type. The set screw type collar typically consists of a collar with a hollow grooved cylindrical opening whereupon a locking screw is manually rotated into the opening until locking contact is made with the barbell. There are varying types of set screw collars on the market, each requiring the user to expend the effort of rotating the locking screw each time a weight change is desired.

In some instances, a weight lifter exercising alone will initially use a collar only to discover that it is cumbersome and time consuming to remove the collars from each end of the barbell every time a weight change is desired. To avoid this result, the weight lifter will cease to place the collar onto the barbell. In other instances, a number of weight lifters using the same set of weights in a gymnasium will pass the weights back and forth among themselves as they complete exercises. Again, one or more of the weight lifters will often elect to dispense with inconvenient collars rather than to break his own momentum or the momentum of the other weight lifters. Unfortunately, dangerous practices of this sort are commonplace.

Additionally, an unstable collar may also negatively effect a weight lifter's execution, as well as causing safety problems. For example, a fundamental requirement of bench pressing exercises is that the weight lifter have sufficient concentration and experience to lift the barbell evenly. For some novice weight lifters this a very difficult process even when weights are secured properly on a barbell. A shifting collar may complicate the process, causing the weights to shift thereby creating a situation where it is impossible to balance the weights properly. Also, a shifting collar, resulting in shifting weights, may create a situation where too much or too little force is exerted by the weight lifter on either end of the barbell. This may cause severe imbalance and possible injury to the weight lifter. Worsening this scenario is the fact that the weight lifter is more likely to lift the weights unevenly toward the end of a set when the weight lifter's muscles are tired and depleted of oxygen. Thus, the weight lifter is less able to respond at the critical moment when a shifting collar creates even more imbalance.

An important consideration, then, in the selection of a collar is that the collar can be easily mounted on or off the barbell and, at the same time, securely hold weights on the barbell. In general, prior art collars that are secure and have desirable safety characteristics are not convenient to use in that they are not easily and quickly removable.

It is accordingly an object of the present invention to provide an improved device for retaining weights on barbells which, when compared with conventional retaining devices, is more convenient to use.

It is a further object to provide an improved locking collar which is easily removed and replaced.

SUMMARY OF THE INVENTION

In carrying out principles of the present invention, in accordance with the preferred embodiment thereof, a collar is provided for retaining weights on a barbell. The collar can be moved on or off the barbell. The improved locking collar comprises a cylindrical housing having first and second ends and a handle connecting to the first and second ends of the cylindrical housing. The central portion of the cylindrical housing raises to form a dome. The dome further raises in at least one location to form a cylindrical tubular casing. The top surface of the cylindrical tubular casing is partially closed. At least one radially extending leg of a grip bar extends through the cylindrical tubular casing and connects to a pad support resting under the dome. At least one spring is biased against the pad support on one end and against the partially closed top surface of the cylindrical tubular casing on the other end. When the spring is fully extended the pad support engages the barbell, thereby securing the collar on the barbell. When the grip bar is moved in the direction away from the barbell, the spring is compressed to disengage the pad support from the barbell.

DESCRIPTION OF THE PRESENTLY PREFERRED EMBODIMENT

Figure 1:
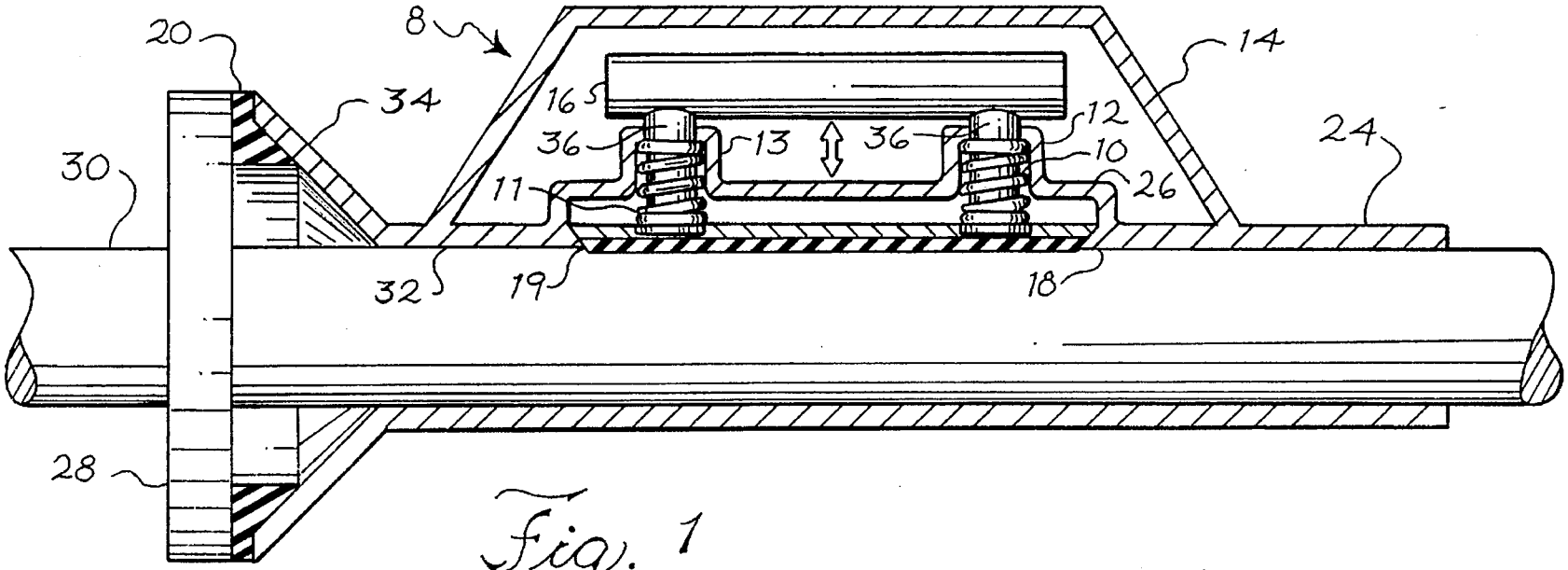
FIG. 1 is a side view of a preferred embodiment of the collar of the present invention.
Figure 2:
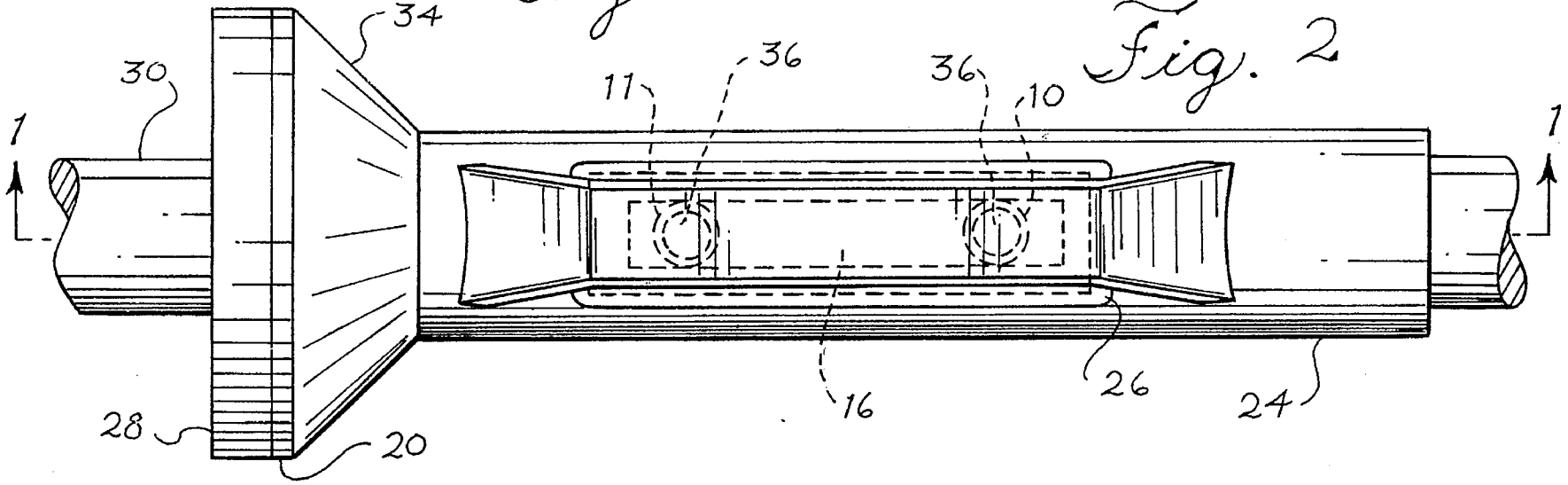
FIG. 2 is a top view of the collar of FIG. 1.

Referring to FIGS. 1 and 2, shown therein and designated by the reference numeral 8 is a preferred embodiment of a collar 8 for securing weights on a barbell 30 constructed in accordance with the present invention. As shown in these FIGS., the collar 8 is comprised of a cylindrical housing 24 with a central opening running longitudinally through its center. This central opening is adapted to receive one end of the barbell 30.

The collar 8 forms a flange 34 at one end of the cylindrical housing 24 against which the weight 28 abuts to secure the weight 28 and other weights on the barbell 30. To prevent slippage between the flange 34 and a contiguous weight 28, the flange 34 preferably has a base 20 made of rubber or some other compressible material. This base may also be fluted to enhance the friction between the weight 28 and the base 20. The collar 8 has a handle 14 connected to the cylindrical housing 24 at the end forming the flange 34 and at the opposite end.

The outer shell of the cylindrical housing 24 raises to form a dome 26 near the central portion of the cylindrical housing 24. The dome 26 raises in two locations forming a pair of cylindrical tubular casings 12, 13. The top surface of each cylindrical casing 12, 13 is partially closed. The partially closed top surfaces are large enough to accommodate the radially extending legs 36 of a grip bar 16. The ends of the legs 36 are connected to a pad support 18, such that raising the grip bar 16 raises the pad support 18.

The pad support 18 rests under the dome 26 of the cylindrical housing 24. A grip pad 19 preferably made of rubber or some other high friction material is disposed on the surface of the pad support 18. In the locking state, the grip pad 19 engages the surface of the barbell 30. A sleeve 32 made of rubber or some other high friction material is bonded to the inner shell of the cylindrical housing 24. The sleeve 32 extends in a circuitous fashion beginning at one end of the grip pad 19 and ending at the other end. When the collar 8 is inserted onto the barbell 30, the inner sleeve 32 makes contact with the barbell 30.

A pair of springs 10, 11 are placed within the cylindrical tubular casings 12, 13 such that the springs 10, 11 envelop the legs 36 of the grip bar 16. The first spring 10 biases against the inner surface of the top of the cylindrical tubular casing 12 on one end and the pad support 18 on the other end. The second spring 11 biases against the inner surface of the top of the cylindrical tubular casing 13 on one end and the pad support 18 on the other end. The distance from the top of the cylindrical tubular casings 12, 13 to the pad support 18 is less than the length of the springs 10, 11 in a non-compressed state. The springs 10, 11 therefore become somewhat compressed when fitted inside of the cylindrical tubular casings 12, 13. In the normal locking state, the tension of the compressed springs 10, 11 keeps the grip pad 19 grippingly engaged against the barbell 30. The exertion of an orthogonal force to the grip bar 16 in the direction away from the barbell 30 will further compress the springs 10, 11 and cause the grip pad 19 to disengage from the surface of the barbell 30. This will allow the collar 8 to move freely axially along the barbell 30. When the grip bar 16 is released, the springs 10, 11 bias the grip pad 19 to engage the barbell 30.

Although the embodiment shown uses spiral springs, it will be recognized that other suitable springs can be used. For example, a compressible rubber material may be used as the spring. Also, while two springs are shown in the preferred embodiment, it should be understood that a different number of springs could be used without straying from the scope of the present invention.

There are several factors that will determine how effective the collar 8 will be in securing weights 28 on the barbell 30. These factors include the amount of force with which the grip pad 19 comes down on the barbell 30, the amount of friction that exists between the surface of the grip pad 19 and the barbell 30, and the area of the contact surface between the grip pad 19 and the barbell 30. Any of these factors can be modified without varying from the spirit of the present invention.

Figures 3, 4:
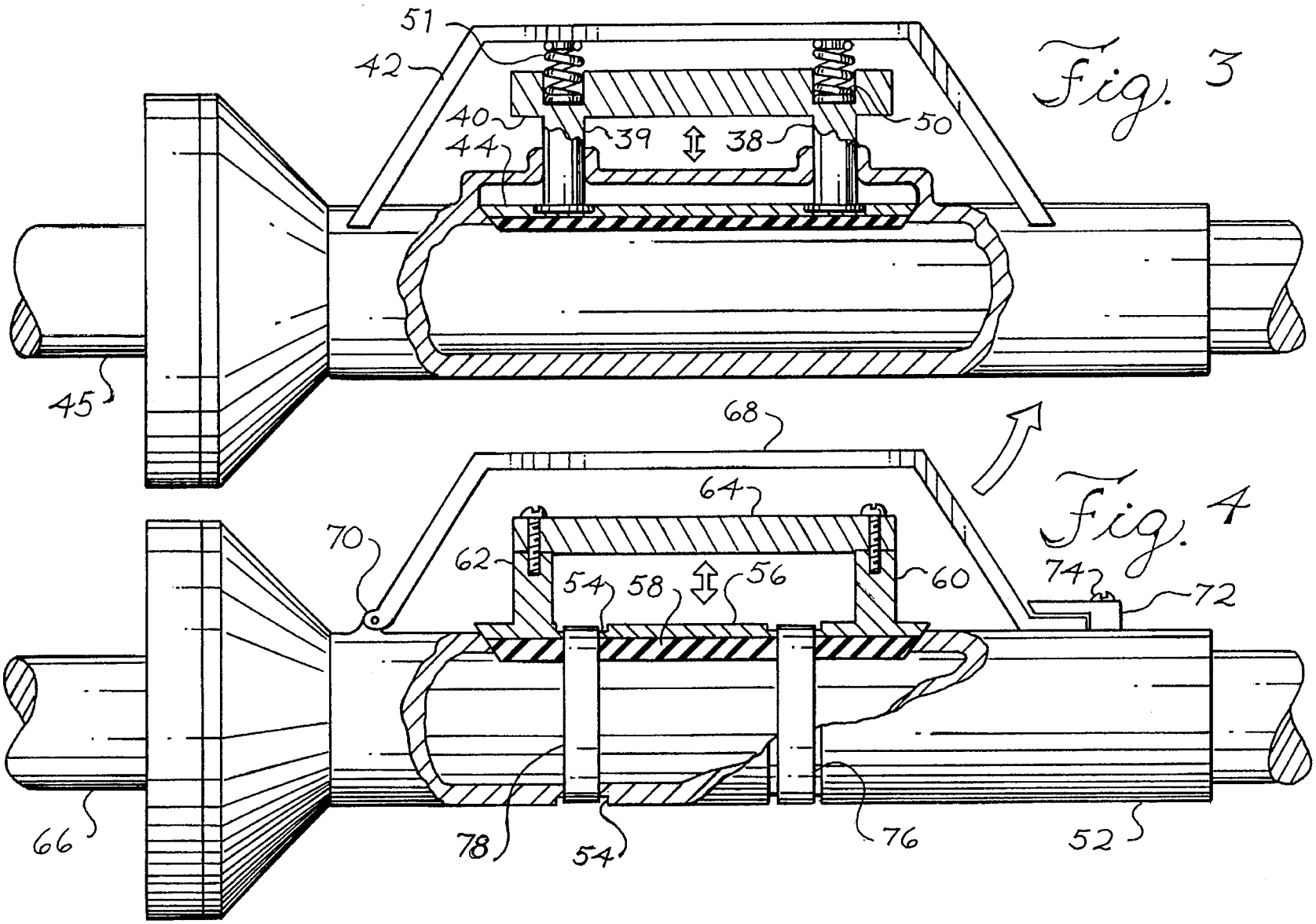
FIG. 3 is an alternative embodiment of the present invention.
FIG. 4 is a second alternative embodiment of the present invention.

FIG. 3 shows an alternative embodiment where two radially extending legs 38, 39 of a grip bar 40 connect to a pad support 44. The radially extending legs 38, 39 of the grip bar 40 are connected to the pad support 44 such that raising the grip bar 40 will raise the pad support 44 off the barbell 45. A pair of springs 50, 51 are attached to the collar handle 42 on one end and to the grip bar on the other end. The tension of the springs 50, 51 in their non-compressed state secures the pad support 44 on the barbell 45.

FIG. 4. is yet another alternative embodiment of the present invention wherein the springs of the present invention are functionally replaced by elastic bands 76, 78. The elastic bands 76, 78 envelop the cylindrical housing 52, fitting into notched grooves 54 in the shell of the cylindrical housing 52 and in the pad support 56. A grip pad 58 is disposed on the surface of the pad support 56. The radially extending legs 60, 62 of a grip bar 64 are connected to the pad support 56 such that raising the grip bar 64 will stretch the elastic bands 76, 78 and raise the grip pad 58 off the barbell 66. The collar handle 68 is connected to the cylindrical housing 52 by a hinge 70 on one end and to a restraining flange 72 with a set screw 74 on the other end, allowing for removal or adjustment of the handle 68.

The operation of the collar 8 of the present invention is now described to the embodiment shown in FIGS. 1 and 2. The collar 8 is mounted and locked onto the barbell 30 by (1) engaging the grip bar 16 of the collar 8 such that the first spring 10 and the second spring 11 are compressed, thereby moving the pad support 18 so that the grip pad 19 of the pad support 18 will not make contact with the barbell 30; (2) placing the collar 8 onto the barbell 30 so that the two are slidingly engaged with their respective axes substantially aligned with each other; (3) sliding the collar 8 along the length of the barbell 30 toward the weight 28 on the barbell 30 until the flange 34, or other weight engagement means, of the collar 8 contacts or approaches the weight; and (4) releasing the grip bar 16 of the collar 8, thereby moving the pad support 18 so that the grip pad 19 of the pad support 18 makes contact with the barbell 30.

The collar 8 is removed from the barbell 30 by (1) engaging the grip bar 16 of the collar 8 such that the first spring 10 and the second spring 11 are compressed, thereby moving the pad support 18 so that the grip pad 19 of the pad support 18 is not in contact with the barbell 30; and (2) sliding the collar 8 along the length of the barbell 30 away from the weight 28 on the barbell 30 until the collar 8 is displaced from the barbell 30.

It will be noted that the construction of the collar 8 of the present invention has been designed to allow the user to easily remove and replace the collar 8, causing less disruption during workouts. Operation of the present invention requires only that the user engage the grip bar 16 and slide the collar 8 on and off the barbell 30.

I claim:

1. A collar for securing weights on a barbell, the collar comprising:

a cylindrical housing having a first and a second end, an opening running longitudinally through the housing adapted to receive the barbell, and a raised central portion forming a dome, said dome raising in at least one location to form a cylindrical tubular casing, said cylindrical tubular casing having a partially closed top surface;

a handle having a first end and a second end, said handle being attached to the cylindrical housing;

a pad support disposed under the dome, said pad support having a grip pad made of a compressible material disposed on the surface of the pad support;

at least one spring biased against the pad support at one end and biased against the partially closed top surface of the cylindrical tubular casing at the other end; and a grip bar having at least one radially extending leg, said leg extending through the cylindrical tubular casing and connecting to the pad support such that when the grip bar is moved, the spring is compressed and the grip pad no longer makes full contact with the barbell thereby defining a non-locking state; whereby said grip pad, biased by said spring, is adapted to contact a sufficient area of a barbell surface with sufficient force and sufficient friction to secure the weights on a barbell.

2. The collar according to claim 1, wherein the diameter of the cylindrical housing increases gradually beginning at a point beyond the first end of the handle through the first end of the cylindrical housing, thereby forming a flanged end which abuts against and secures said weights, and which facilitates placement of said collar onto said barbell.

* * * * *